US006223632B1

(12) United States Patent
Johnson

(10) Patent No.: US 6,223,632 B1
(45) Date of Patent: May 1, 2001

(54) ADJUSTABLE PIPE WRENCH, GEAR ACTUATED, HAVING TWO METHODS OF ADJUSTMENT

(75) Inventor: Mike Scott Johnson, 8356 Alstan Ave., Hesperia, CA (US) 92345

(73) Assignee: Mike Scott Johnson

( * ) Notice: Subject to any disclaimer, the term of this patent is extended or adjusted under 35 U.S.C. 154(b) by 0 days.

(21) Appl. No.: 09/650,480

(22) Filed: Aug. 29, 2000

Related U.S. Application Data

(60) Provisional application No. 60/152,007, filed on Sep. 1, 1999.

(51) Int. Cl.[7] ..... B25B 13/16
(52) U.S. Cl. ..... 81/167; 81/164; 81/169
(58) Field of Search ..... 81/167, 169, 164, 81/166

(56) References Cited

U.S. PATENT DOCUMENTS 564,513 * 7/1896 Friede ..... 81/167
1,012,036 * 12/1911 Vinton ..... 81/166
1,030,232 * 6/1912 Cole ..... 81/169
1,465,470 * 8/1923 Gloor ..... 81/167
1,475,755 * 11/1923 Dies ..... 81/166
1,591,823 * 7/1926 Henslee ..... 81/164
1,727,623 * 9/1929 Thewes ..... 81/166
1,929,258 * 10/1933 Petersen et al. ..... 81/164
1,966,773 * 7/1934 Tilston ..... 81/166
3,015,246 * 1/1962 Buyer ..... 81/167
3,046,821 * 7/1962 Iegris ..... 81/164
3,093,019 * 6/1963 Bohnet ..... 81/166

* cited by examiner

*Primary Examiner*—James G. Smith
*Assistant Examiner*—Hadi Shakeri

(57) ABSTRACT

A wrench includes a tubular extension secured in the second jaw member by set screws. The tubular extension is connected on one side by the adjusting handle and is connected to the bored gear on the second side. When the handle is rotated, the internally threaded gear drives first jaw portion in and out and is also exposed for conventional hand adjustment.

2 Claims, 1 Drawing Sheet

Fig. 2

III

ADJUSTABLE PIPE WRENCH, GEAR ACTUATED, HAVING TWO METHODS OF ADJUSTMENT

This application claims benefit of Provisional No. 60/152,007 filed Sep. 1, 1999.

BACKGROUND

1. Field of Invention

This invention relates to a pipe wrench which can be adjusted from a rotatable handle and can be adjusted in the conventional way by turning the exposed gear.

2. Description of Prior Art

Typical wrenches comprise a tubular handle that is threadedly engaged with the outside thread of the movable jaw portion. This restricts the free play of the movable jaw portion and decreases the effectiveness of the wrench. Maintaining the standard characteristics of a pipe wrench with the addition of a rotatable handle is not achieved.

SUMMARY OF THE INVENTION

The objective of this wrench is to provide a wrench having a rotatable handle for easy adjustment. The exposed internally threaded gear allows adjustment in the conventional manner of a standard pipe wrench.

DRAWING DESCRIPTION

DESCRIPTION

Figure 1:
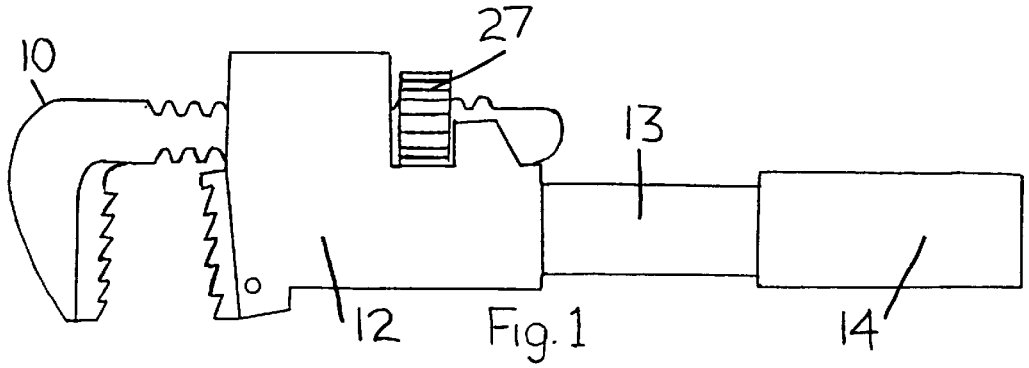
FIG. 1 is a side view of the improved wrench of this invention.
Figure 2:
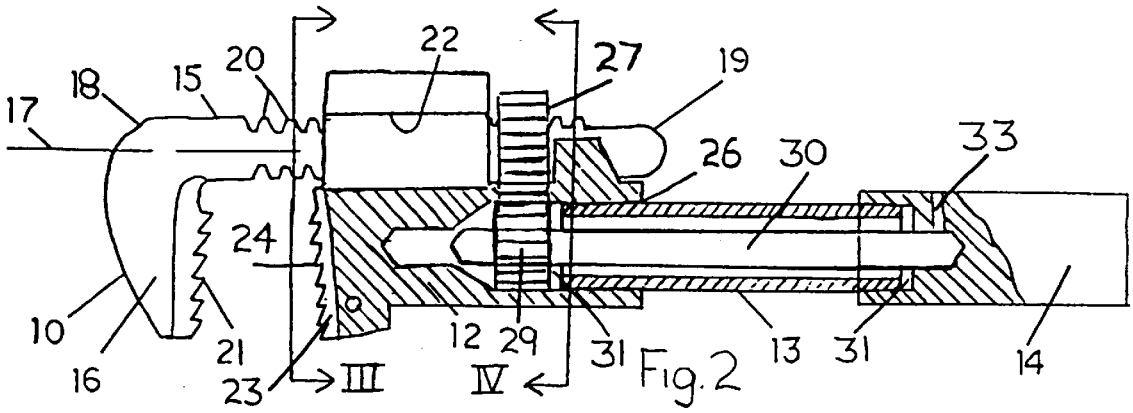
FIG. 2 is a cross sectional view of FIG. 1.
Figure 4:
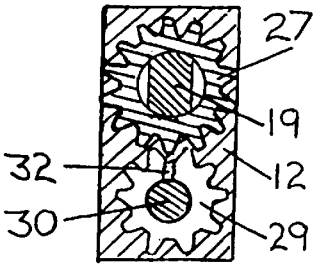
FIG. 4 is a sectional view substantially taken along section line 4—4.

The present invention relates to a wrench, specifically to an adjustable wrench commonly known as pipe wrench. This wrench is much easier to adjust to size and can be inexpensively manufactured.

A conventional pipe wrench is provided with a knurled wheel rotatably mounted in the lower jaw portion of the wrench and engaged by threads with the other member of the wrench for moving the jaw portions toward and away from each other. This wheel is usually mounted in such a way that only the peripheral edge of the wheel is accessible to the person adjusting the wrench. This makes it necessary to use two hands to adjust the wrench. Therefore, the object of this invention is to provide an improved wrench construction for an adjustable wrench which can be manufactured more inexpensively than conventional wrenches and which permits the jaw portions of the wrench to be moved toward and away from each other by rotating the handle portion or by turning the rotator nut by hand. This enables the user two methods of adjusting, depending on the specific application.

Referring to the drawings, the improved wrench of this invention is shown to comprise of a first jaw member 10, a second jaw member housing 12, a tubular handle extension 13, and a rotatable handle 14. Member 10 has a substantially straight bar portion 15 and first jaw portion 16. Bar portion 16 has an axis 17, a generally rectangular cross sectional shape and opposite ends 18 & 19. Extending from end 19, a partial length of bar portion 15 toward end 18 are threads 20. Jaw portion 16 is secured to bar portion 15 adjacent end 18 with a gripping surface 21 facing the threads 20. Gripping surface 21 is generally perpendicular to the axis 17.

The second jaw member 12 is provided with an aperture 22 extending through the length of jaw member 12 and a second jaw portion with a gripping member 23 connected thereto. Gripping member 23 is shown in the drawing to be offset 7 degrees from perpendicularity to axis 17.

Figure 3:
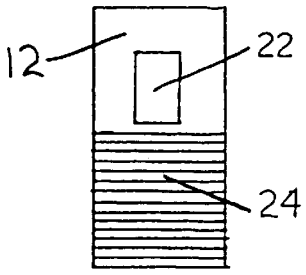
FIG. 3 is a view of the second jaw member body, viewed in a direction perpendicular to the gripping surface of the said jaw member taken along section line 3—3.

Aperture 22 has a cross-sectional area having a rectangular shape which is geometrically similar to the overall shape of the cross section of bar portion 15. (FIG. 3). However, the cross-sectional area of aperture 22 has a size slightly larger than the cross section of bar portion 15, such that bar portion 15 can be inserted within the aperture 22 and the jaw member 12 can be slid relatively axially along bar portion 15 between end 19 and a position in which the gripping surfaces 21 and 23 are engaged.

When jaw member 15 is so mounted on jaw member 12, the axis of the aperture 22 and the axis 17 of bar 15 are generally coincident, and thus the bar portion 15 and the aperture 22 are coaxial of each other. The relative sizes of the respective cross sections of the bar portion 15 and the aperture 22 prevent the jaw member 12 from being rotated about the axis 17 and the bar portion 15. The gripping surface 23 will always be in registry with the gripping surface 21 as the bar portion 15 is slid relatively along the jaw member 12.

Jaw member 12 further is provided with a hole 26 slightly larger than the diameter of tubular handle extension 13. This hole 26 is open on the top side facing the nut-gear 27. Tubular handle 13 is secured in jaw member 12 by set screw 28. Nut-gear 27 has mating inside threads to 20 of jaw member 15. The outside diameter is geared to mesh with lower gear 29.

Rotatable handle 14 is drilled from one end to accept rod 30. Rod 30 is supported in tubular handle extension 13 by bronze bushings 31 at both ends. Lower gear 29 is connected to rod 30 at opposite end of handle 14. When handle 14 is rotated, the lower gear 29 turns the nut-gear 27 and subsequently moves jaw member 15 in or out. Handle 14 is bored on one end to accept rod 30 and is secured by set screw 33. Lower gear 29 is bored likewise to accept opposite end of rod 30. Lower gear 29 is attached to rod 30 by set screw 32. Tubular handle extension 13 is bored on both ends to accept bronze bushings 31, which in turn are bored slightly larger than the diameter of rod 30. This enables easy rotation of handle 14 inside of handle extension 13 enabling jaw member 10 to be adjusted in and out respective to direction of handle rotation.

What is claimed is:

1. A pipe wrench comprising:

a stationary jaw member, having an aperture extending there through, an adjustable jaw member having a bar portion inserted within said aperture, an a tubular extension secured to said stationary jaw member at a first end and further being secured to a rotatable handle at a second end, an a drive rod having two ends, secured to the handle at one end and connected to a gear at the other end and further being rotatably disposed within said tubular extension, an said gear engaging an internally threaded gear, said internally threaded gear being dispose on said bar portion and engaging said bar portion via the internal threads, thereby projecting or retracting said adjustable jaw member by the rotation of the handle.

2. The wrench according to claim 1 wherein said internally threaded gear is exposed enabling conventional adjustment as well as adjustment by means of said rotatable handle.

* * * * *